US005803820A

United States Patent [19]

McCarty

[11] Patent Number: 5,803,820

[45] Date of Patent: Sep. 8, 1998

[54] PORTABLE SAND TRAP

[76] Inventor: George J. McCarty, 2829 Sherbrooke Rd., Toledo, Ohio 43606

[21] Appl. No.: 822,231

[22] Filed: Mar. 21, 1997

[51] Int. Cl.[6] ..... A63B 69/36

[52] U.S. Cl. ..... 473/173; 473/162

[58] Field of Search ..... 472/126; 473/160, 473/173, 150, 161, 162, 168, 170

[56] References Cited

U.S. PATENT DOCUMENTS

| | | | |
|---|---|---|---|
| 2,848,229 | 8/1958 | Miller | 472/126 |
| 3,025,059 | 3/1962 | DiBuono . | |
| 3,871,661 | 3/1975 | Korff | 473/160 |
| 4,535,989 | 8/1985 | Lovin . | |
| 4,630,828 | 12/1986 | Lovin . | |
| 5,002,280 | 3/1991 | Hines . | |
| 5,203,566 | 4/1993 | Ricigliano . | |
| 5,383,665 | 1/1995 | Schultz et al. . | |
| 5,564,988 | 10/1996 | Brooks . | |

*Primary Examiner*—Mark S. Graham
*Attorney, Agent, or Firm*—Marshall & Melhorn

[57] ABSTRACT

A portable sand trap for use as a golf instructional for teaching and practicing golf shots from sand. The portable sand trap is placed in various locations and at various distances from a target or hole on a driving range, golf course, indoor practice facility or personal property. The apparatus includes a base having a bottom section, a sidewall, and an open top. The bottom section and the sidewall form an internal retention area in the base. The internal retention area is designed for holding sand. The apparatus is rendered mobile through a plurality of ground engaging wheels attached to the base. The base may be pushed or towed about by an individual or by a vehicle.

25 Claims, 3 Drawing Sheets

PORTABLE SAND TRAP

BACKGROUND OF THE INVENTION

1. Field of the Invention

This invention relates to a portable sand trap for use as a golf instructional aid, and more particularly to a portable sand trap for practicing golf shots from the sand. The invention utilizes a base with a retention area for holding sand. A plurality of ground engaging wheels are attached to the base which render the base mobile for select placement about a practice range, golf course, indoor practice facility, or personal property. The mobility of the invention permits the selection of golf shots at various distances from a target. Additionally, the apparatus may be moved to a storage location when not in use.

2. Summary of Related Art

The invention is particularly adapted as a golf instructional aid for teaching and practicing golf shots from sand. To become proficient at the game of golf, an individual must practice the various shots encountered on a golf course. When practicing off of the golf course, it is important to simulate actual playing conditions encountered on the course to properly correct deficiencies and improve various golf shots. It is also desirable to have portable practice devices to vary the location and look of golf shots. More importantly, portable devices can be stored away when not in use. The simulation of golf shots from sand traps or bunkers is difficult to achieve short of installing an actual trap.

Existing practice devices generally involve the use of box-like structures filled with sand. For example, U.S. Pat. No. 3,025,059 discloses a sand trap golfing game wherein the sand is placed in a partitioned area of a large box-like structure. The remaining area of the structure serves as a receiving area for golf balls as they are hit from the sand area. The apparatus is large and therefore designed as a permanent installation.

U.S. Pat. Nos. 4,535,989 and 4,630,828 disclose sand trap practice devices. The devices generally include supporting framework which outline an area for retaining sand. The framework comprises either a solid tray or tubular framework which outlines a rectangular area. Foldable sheet material is placed within the framework or structure and serves as a lining for holding the sand. An excess of foldable material extends outward from the framework or structure and functions as an apron for catching sand that is sprayed out of the receptacle during the golf shot. The apron is folded inward after use to put the sand back in the receptacle and to protect the sand from the elements when not in use. The foldable material is made of a water resistant sheet of plastic to protect the sand from the elements when stored outdoors. The size of the structure renders the apparatus semi-portable.

Thus, existing practice devices for simulating shots from sand traps or bunkers generally involve large structures or structures which are not readily portable. The devices include rectangular structures which are large enough to permit an individual to stand within the structure while striking a golf ball. The amount of sand required to fill the structures and the depth of sand needed to simulate a sand trap significantly reduce the mobility of the device. Additionally, the sand traps disclosed in the prior art fail to address drainage issues associated of the devices in an outdoor setting.

It would be an advantage to provide a portable sand trap for use as a golf instructional aid. A portable device would enable the use of the apparatus in different settings in a practice environment to vary the location and look of golf shots from the sand. Furthermore, a portable device could be moved out of the elements or to another location for storage when not in use.

It would also be an advantage to design a portable sand trap that is capable of draining water when used in an outdoor environment. The retention of water in a simulated sand trap or bunker would significantly increase the weight of the unit thereby adversely affecting the mobility of the trap. Additionally, the retention of water would affect the consistency of the sand in the trap.

SUMMARY OF THE INVENTION

In accordance with the present invention, there is provided a portable apparatus for simulating a sand trap or bunker in a practice environment. The apparatus is designed as a golf instructional aid which is placed in various locations and at various distances from a target or hole on a practice range. Moreover, the mobility of the apparatus permits the removal and storage of the device away from the elements.

The apparatus includes a base having a bottom section, a sidewall, and an open top. The bottom section and the sidewall form an internal retention area in the base. The internal retention area is designed for holding sand. Furthermore, the retention area is sized so that an individual may stand within the area and strike a golf ball placed therein. The retention area is deep enough to permit the striking of the ball.

The apparatus is rendered mobile through a plurality of ground engaging wheels attached to the base. The base may be pushed or towed about by an individual or by a vehicle. Alternatively, the base may be self propelled by electrical or mechanical means.

Additionally, the device includes a means for immobilizing the base during use. The immobilizing means stabilizes the device in a fixed position relative to the ground. Therefore, the base does not move while an individual, standing on the sand in the base, strikes a golf ball placed in the sand.

The present invention may optionally include a bottom section constructed of a permeable material and a rigid bottom with openings that permit water to pass through the sand in the base. The drainage feature enhances the ability of the device to withstand an outdoor environment. Furthermore, the drainage feature maintains the mobility of the apparatus by preventing excessive weight due to water.

It is an objective of the present invention to provide a portable sand trap for practicing golf shots. The device simulates an actual sand trap and is utilized in various indoor or outdoor practice settings. The mobility of the device enables the placement of the sand trap in various positions to change the distance and look of golf shots with respect to the target. Furthermore, the sand trap may be moved to a storage location when not in use.

It is also an objective of the present invention to provide a golf practice device that is capable of withstanding the elements when applied in an outdoor environment. The present invention optionally includes a base with a bottom section designed to permit water to pass through the sand thereby enhancing the ability of the device to withstand the elements in an outdoor setting.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION OF THE PREFERRED EMBODIMENT

Figure 1:
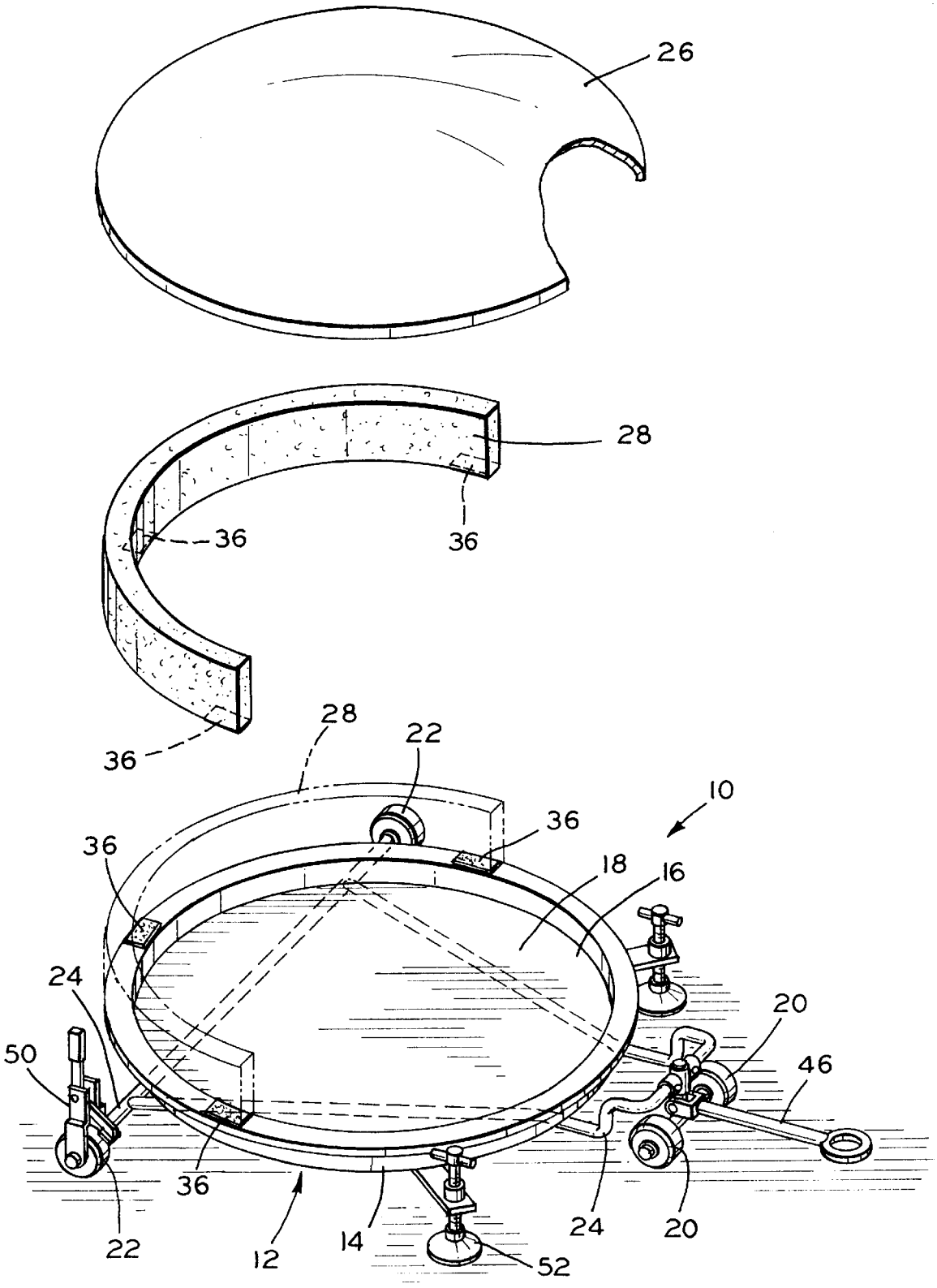
FIG. 1 is an exploded perspective view of an apparatus embodying the present invention.

There is shown generally in FIG. 1 a portable sand trap 10 for use as a golf instructional aid on either an indoor or outdoor practice range. The device 10 is suitable for practicing golf shots from the sand (not shown) by an individual standing on the sand in the base. The mobility of the device enables the use of the device in various locations in order to change the appearance of the shot with respect to the target, and with respect to the contour of the terrain.

As illustrated in FIGS. 1, the device 10 is generally a base 12 having a sidewall 14, bottom section 16, and open top. The bottom section 16 and sidewall 14 form a retention area 18 within the base 12 that is suitable for holding sand (not shown). The mobility of the base is accomplished by attaching a plurality of ground engaging wheels 20,22. The embodiment depicted in FIG. 1 includes wheels 20,22 attached to a carriage assembly 24. A means for immobilizing the base 12 is necessary to prevent unwanted movement of the base while an individual is standing on the sand in the base 12. A cover 26, for sheltering the sand from the elements, and an adjustable lip 28, as an obstacle to strike the ball over, are optional features with the present invention and are illustrated in an exploded view in FIG. 1.

In accordance with the present invention, there is provided a base 12 having a bottom section 16, a sidewall 14 and an open top. An internal retention area 18 for holding sand is formed in the base by the sidewall 14 and bottom section 16. The base 12 is large enough to permit an individual to stand on the sand and swing a golf club in order to strike a ball placed in the sand. The shape of the base 12, which closely simulates that of an actual trap, is generally circular with a preferred diameter of about 5 feet. However, the base 12 may take on various other sizes and dimensions The bottom section 16 is generally a planer, rigid panel strong enough to support the weight of the sand and an individual standing in the sand. Suitable materials for construction of the bottom section include metals, metal alloys, wood, polymers, fiber reinforced polymers or other conventional materials suitable for forming a rigid panel.

Because the inventive device may be utilized in an outdoor setting, the bottom section 16 may optionally include a means for draining water from the sand. The ability to remove water from the sand is important in maintaining a lightweight device for mobility and for maintaining the appropriate consistency of the sand. In accordance with the FIG. 2, the flow of water from the base 12 is accomplished through the utilization of a water permeable material 30 placed over a rigid bottom panel 32 having openings or perforations 34. The material is placed over the rigid bottom panel 32 and rests between the rigid bottom panel 32 and the sand 44. The material 30 has a controlled pore structure that allows water to pass but prevents the sand 44 from passing through the material. The water then flows through the openings or perforations 34 in the rigid bottom panel 32. Conventional water permeable materials are suitable for use with the present invention. The rigid bottom panel 32 may be constructed from the conventional materials previously noted. For example, the bottom may include expanded metal or a polymer grid.

As illustrated in FIG. 1, the sidewall 14 of the base 12 is generally a rigid panel connected to the outer perimeter of the bottom section 16. The sidewall 14 can be a single continuous panel or sections attached to the bottom section. It may also have various configurations. Additionally, the sidewall may be integrally formed with the bottom section 16. The sidewall 14 forms the vertical sides of the retention area 18 and maintains the depth of the sand in the base. The sidewall 14 is preferably sized to maintain 4–6 inches of sand in the base.

The sidewall 14 of the present invention may optionally support an adjustable lip 28, as illustrated in FIG. 1. The lip 28 may be placed around a select portion, or the entirety, of the sidewall 14 of the base 12. The lip 28 functions as an obstacle to strike the ball over and is intended to simulate a raised edge of an actual sand trap. In general, the lip 28 is removably attached to the sidewall 14 of the base as indicted in phantom in FIG. 1. The lip may be removed from the sidewall 14 when the apparatus of the present invention is not in use. Conventional fastening means, such as hook and loop type fasteners, adhesives, or securing straps, are suitable for attaching the lip to the sidewall. FIG. 1 illustrates the use of hook and loop type fasteners 36 to secure the lip 28 onto the sidewall 14. The lip 28 is made of shock absorbing materials. Various heights and dimensions are suitable for the lip 28.

Figure 2:
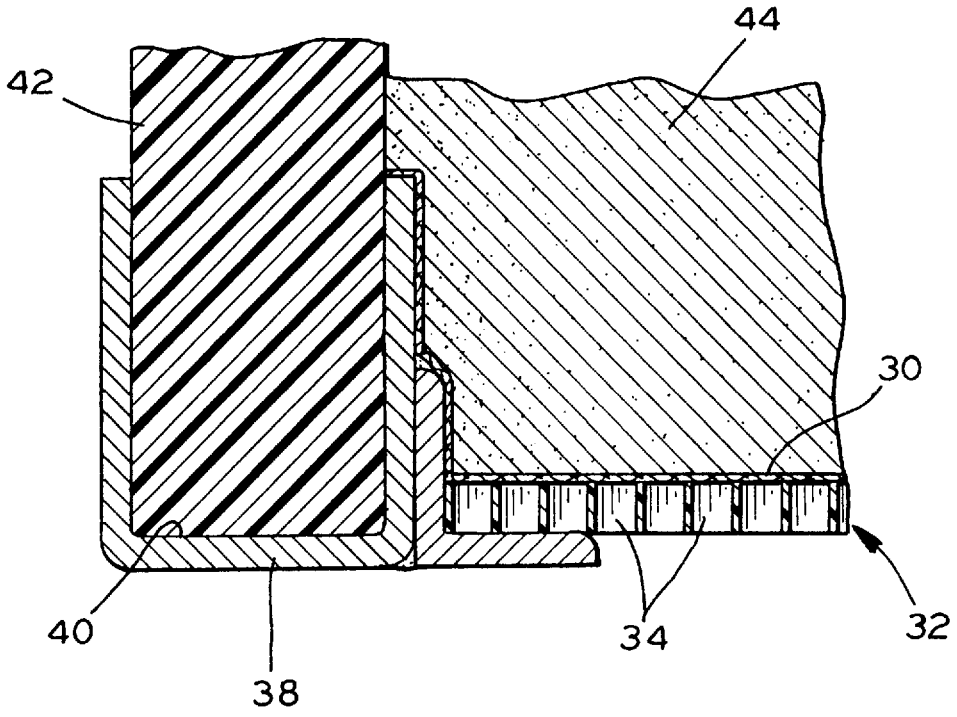
FIG. 2 is a sectional side view of a U-shaped sidewall and the bottom section highlighting the use of water permeable material with a perforated rigid bottom and a lip placed in the U-shaped sidewall.
Figure 3:
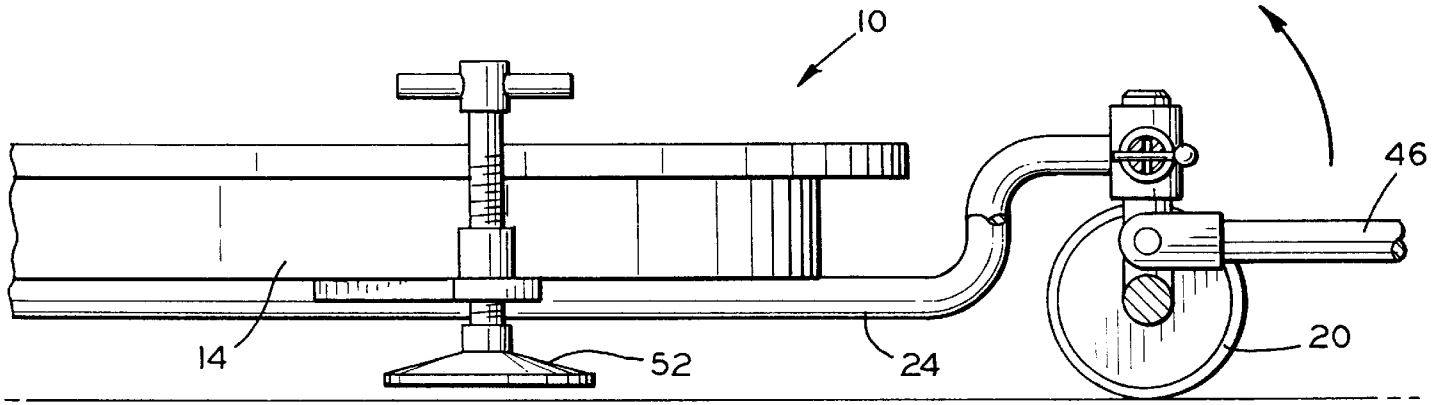
FIG. 3 is an elevational view of a portion of the apparatus illustrating the retractable wheels in accordance with the present invention.
Figure 4:
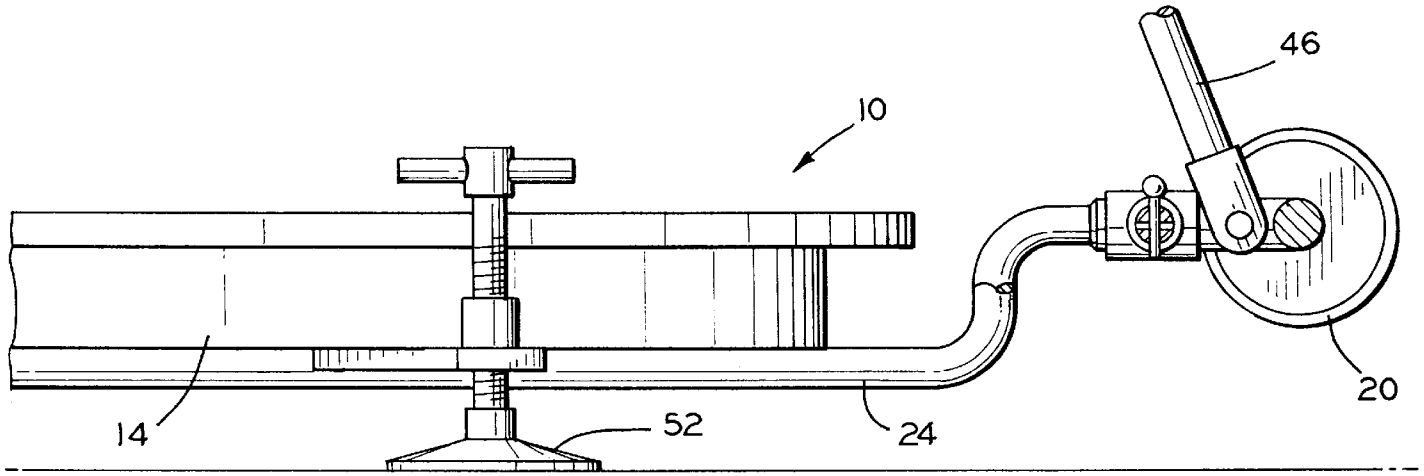
FIG. 4 is an elevational view of a portion of the apparatus illustrating the retractable wheels in accordance with the present invention.

An alternative embodiment is illustrated in FIG. 2. A U-shaped sidewall 38, having an internal channel 40, is utilized to support an adjustable lip 42. The base of the lip 42 rests in the internal channel 40 of the U-shaped sidewall 38 with the upper portion extending above the edges of the sidewall to function as the obstacle. Thus, lips with different heights may be selectively inserted into the channel 40 to change the look of the golf shot from the base 12.

The portable sand trap of the present invention may optionally include a cover 26, as illustrated in FIG. 1. The cover 26 is constructed of a water resistant material and is placed over the base 12 to protect the sand from the elements when the sand trap 10 is not in use. The cover may attach to the sidewall 14 of the base 12 or to the lip 28, depending on the particular embodiment of the invention. Conventional attaching mechanisms are suitable in securing the cover 26 to the base 12. The cover 26 may also serve as a catch basin for the sand during use of the trap 10 by an individual. The cover 26 may be turned upside down and placed on the ground or surface in front of the trap 10 in the direction of which the ball will be hit. The sand is then easily returned to the retention area 18.

The portable sand trap 10 of the present invention is transported through then use of a plurality of ground engaging wheels 20,22 attached to the base 12. The ground engaging wheels 20,22 may be attached directly to the base 12 or attached to the base 12 through the use of a carriage assembly 24 as illustrated in FIG. 1. The wheels 20,22 support the weight of the base 12 and are capable of traversing various earthen or paved surfaces for indoor or outdoor applications of the invention. In a preferred embodiment, a carriage assembly 24, having at least one rotating wheel, is used in order to steer and position the base 12 in a desired location. FIG. 1 depicts a carriage assembly 24 with two rotating wheels 20 used in conjunction with two fixed wheels 22. A hitch or tow bar 46 is attached to the carriage assembly near the rotating wheels 20 to facilitate movement of the inventive device. The device may be moved manually with the aid of the tow bar 46 or connected directly to another vehicle and towed to a select location. In an alternative embodiment, a motor may be connected to the carriage assembly or the base thus providing a self-propelled device.

The portable sand trap of the present invention must be immobilized while in use by individual to prevent unsafe shifting or movement of the device. A means for immobilizing the base 12 must be attached to the invention. The means may include a braking system 50 associated with the wheels 20,22 or carriage system 24. The immobilization means may also include at least one ground engaging leg 52 attached to the base or the carriage assembly. A ground engaging leg extends or screws downward from the base 12 or carriage assembly 24 and contacts or grips the surface. Since the device is utilized on both hard and soft surfaces, different contact points are needed to immobilize the device. For example, on soil, a ground engaging leg may include a spike that extends downward into the soil. For hard surfaces, contact pads are needed to grip the surface and prevent shifting of the apparatus. In an alternative embodiment, the means for immobilizing the base 12 could include retractable wheels. The retractable wheels would allow the base, or at least a large portion of the base, to rest directly on the ground.

The internal retention area 18 of the base 12 is filled with sand to a depth of preferably 4–6 inches. The preferred sand composition is #1 mason sand. However, other types of sand or particulate materials may be used with the present invention.

In operation, the portable sand trap 10 is moved to a desired location on a golf course, driving range, indoor practice facility, or personal property. The device is immobilized by lowering the ground engaging legs or by manually applying a braking system connected to the wheels. Once the base is stabilized, an individual may stand on the sand in the base 12. The individual may then practice hitting a golf ball from a placement in the sand toward a target at a given distance from the portable sand trap. Upon completion of the practice session, the device may be covered and optionally moved to a storage location until needed.

It is to be understood that the forms of the invention herewith shown and described are to be taken as illustrative embodiments only of the same, and that various changes in the shape, size and arrangement of parts, as well as various procedural changes, may be resorted to

What is claimed is:

1. A portable sand trap for practicing golf shots, comprising;

(a) a base having a bottom section, a sidewall, and an open top, the bottom section and sidewall forming an internal retention area in said base;

(b) a plurality of ground engaging wheels attached to said base, the wheels rendering said base mobile;

(c) sand held within the internal retention area of said base, wherein said base allows water to pass through and drain from the internal retention area while inhibiting said sand from passing through said base from the internal retention area; and (d) a means for immobilizing said base in a fixed position relative to the ground so that the portable sand trap does not move while an individual, standing in the portable sand trap, swings a golf club and strikes a golf ball placed in the sand.

2. A portable sand trap as recited in claim 1, wherein said means for immobilizing said base includes ground engaging legs attached to said base.

3. A portable sand trap as recited in claim 1, wherein said means for immobilizing said base includes a braking system connected to said wheels.

4. A portable sand trap as recited in claim 1, wherein said means for immobilizing said base includes retractable wheels so that as the wheels are retracted, a portion of said base rests on the ground.

5. A portable sand trap as recited in claim 1, wherein said bottom section includes a water permeable material placed over a rigid bottom, said rigid bottom having openings, the water permeable material and openings in the rigid bottom allowing water to pass through the sand in said base.

6. A portable sand trap as recited in claim 1, wherein said plurality of wheels are provided in a carriage assembly attached to said base.

7. A portable sand trap as recited in claim 6, wherein said carriage assembly includes a hitch to enable towing of the portable sand trap.

8. A portable sand trap as recited in claim 1, further comprising a water resistant cover removably attached to said base, said cover sheltering the sand in the retention area when said cover is placed over said base.

9. A portable sand trap as recited in claim 1, further comprising a lip attached to a perimeter of said base, said lip serving as an obstacle to strike the ball over.

10. A portable sand trap as recited in claim 9, wherein said lip is removably attached to said base.

11. A portable sand trap as recited in claim 9, wherein said sidewall is U-shaped and said lip is positioned in, and extends above, said U-shaped sidewall.

12. A portable sand trap as recited in claim 1, wherein the sidewall and bottom section are integrally formed.

13. A portable sand trap for practicing golf shots, comprising;

(a) a base having a bottom section, a sidewall, and an open top, the bottom section and sidewall forming an internal retention area in said base, said bottom section formed by a water permeable material placed over a rigid bottom, the rigid bottom having openings, the water permeable material and openings in the rigid bottom allowing water to pass through the sand in said base;

(b) a carriage assembly attached to said base, said carriage assembly having a plurality of ground engaging wheels, the wheels rendering said base mobile;

(c) sand held within the internal retention area of said base; and (d) a means for immobilizing said base in a fixed position relative to the ground so that the portable sand trap does not move while an individual, standing in the portable sand trap, swings a golf club and strikes a golf ball placed in the sand.

14. A portable sand trap as recited in claim 13, wherein said means for immobilizing said base includes ground engaging legs attached to said base.

15. A portable sand trap as recited in claim 13, wherein said means for immobilizing said base includes a braking system connected to said wheels.

16. A portable sand trap as recited in claim 13, wherein said carriage assembly includes a hitch to enable towing of the portable sand trap by another vehicle.

17. A portable sand trap as recited in claim 13, further comprising a water resistant cover removably attached to said base, said cover sheltering the sand in the retention area when said cover is placed over said base.

18. A portable sand trap as recited in claim 13, further comprising a lip attached to a perimeter of said base, said lip serving as an obstacle to strike the ball over.

19. A portable sand trap for practicing golf shots, comprising;

(a) a base having a bottom section, a sidewall, and an open top, the bottom section and sidewall forming an internal retention area in said base, said bottom section formed by a water permeable material placed over a rigid bottom, the rigid bottom having openings, the water permeable material and openings in the rigid bottom allowing water to pass through the sand in said base;

(b) a carriage assembly attached to said base, said carriage assembly having a plurality of ground engaging wheels, the wheels rendering said base mobile;

(c) sand held within the internal retention area of said base;

(d) a water resistant cover removably attached to said base, said cover sheltering the sand in the retention area when said cover is placed over said base; and (e) ground engaging legs attached to said base for immobilizing said base in a fixed position relative to the ground so that the portable sand trap does not move while an individual, standing in the portable sand trap, swings a golf club and strikes a golf ball placed in the sand.

20. A portable sand trap as recited in claim 19, further comprising a lip attached to a perimeter of said base, said lip serving as an obstacle to strike the ball over.

21. A portable sand trap as recited in claim 20, wherein said sidewall is U-shaped and said lip is positioned in, and extends above, said U-shaped sidewall.

22. A portable sand trap for practicing golf shots, comprising;

(a) a base having a bottom section, a sidewall, and an open top, the bottom section and sidewall forming an internal retention area in said base, wherein said bottom section includes a water permeable material placed over a rigid bottom, said rigid bottom having openings;

(b) a plurality of ground engaging wheels attached to said base, the wheels rendering said base mobile;

(c) sand held within the internal retention area of said base such that the water permeable material and openings in the rigid bottom allow water to pass therethrough while retaining said sand in the internal retention area; and (d) a means for immobilizing said base in a fixed position relative to the ground so that the portable sand trap does not move while an individual, standing in the portable sand trap, swings a golf club and strikes a golf ball placed in the sand.

23. A portable sand trap for practicing golf shots, comprising;

(a) a base having a bottom section, a sidewall, and an open top, the bottom section and sidewall forming an internal retention area in said base;

(b) a plurality of ground engaging wheels attached to said base, the wheels rendering said base mobile;

(c) sand held within the internal retention area of said base, wherein said base allows water to pass through and drain from said internal retention area while inhibiting sand from passing through said base from said internal retention area;

(d) a lip attached to said base, said lip serving as an obstacle to strike a ball over; and (e) a means for immobilizing said base in a fixed position relative to the ground so that the portable sand trap does not move while an individual, standing in the portable sand trap, swings a golf club and strikes a golf ball placed in the sand.

24. A portable sand trap as recited in claim 23, wherein said lip is removably attached to said base.

25. A portable sand trap as recited in claim 23, wherein said sidewall is U-shaped and said lip is positioned in, and extends above, said U-shaped sidewall.

* * * * *